United States Patent [19]

Johnson et al.

[11] 4,324,348

[45] Apr. 13, 1982

[54] DISPENSER FOR DISPENSING LIQUID FROM A REPLACEABLE CONTAINER

[75] Inventors: Logan Johnson, Edina; Grant Wood, Long Lake; Jerry Brofft, Minnetonka, all of Minn.

[73] Assignee: Minnetonka, Inc., Minnetonka, Minn.

[21] Appl. No.: 113,216

[22] Filed: Jan. 18, 1980

[51] Int. Cl.[3] ..... B65D 37/00

[52] U.S. Cl. ..... 222/181; 222/183; 222/185; 222/212; 222/214; 222/505; 222/517

[58] Field of Search ..... 222/214, 212, 96, 181, 222/182, 183, 185, 505, 512, 515, 517; 220/90.4, 90.2, 263, 264, 335

[56] References Cited

U.S. PATENT DOCUMENTS

| | | | |
|---|---|---|---|
| 2,917,209 | 12/1959 | Kujanik, Jr. | 222/515 X |
| 3,090,528 | 5/1963 | Ellis | 222/214 X |
| 3,380,631 | 4/1968 | Perrinjaquet | 222/96 |
| 3,926,347 | 12/1975 | Low et al. | 222/214 X |
| 3,945,524 | 3/1976 | Tkaciukas | 222/181 X |

FOREIGN PATENT DOCUMENTS

| | | | |
|---|---|---|---|
| 2557697 | 6/1977 | Fed. Rep. of Germany | 220/335 |
| 820708 | 11/1937 | France | 222/517 |
| 1190344 | 10/1959 | France | 222/96 |

*Primary Examiner*—Charles A. Marmor
*Attorney, Agent, or Firm*—Merchant, Gould, Smith, Edell, Welter & Schmidt

[57] ABSTRACT

A dispensing enclosure 12 for holding a liquid container 14 in an inverted position is disclosed. In the inverted position, the dispensing opening 22 of the liquid container 14 is disposed downwardly. The enclosure 12 is formed as a two part housing having a first portion 26 and a second portion 86. A plug 70 selectively closes the dispensing opening 22.

22 Claims, 10 Drawing Figures

DISPENSER FOR DISPENSING LIQUID FROM A REPLACEABLE CONTAINER

TECHNICAL FIELD

The present invention relates to the field of fluid dispensers. More particularly, the present invention relates to liquid dispensers for dispensing liquids such as shampoos, hair conditioners, soaps and the like.

BACKGROUND OF THE INVENTION

Numerous types of liquid dispensers have been known in the prior art. One type of liquid dispenser is a wall-mountable dispenser which is commonly used in public washrooms. This type of dispenser generally has a housing which serves as a liquid reservoir for holding the liquid to be dispensed. A hand actuated pump mechanism forces the liquid out of the reservoir. After the liquid has been used up, replacement liquid must be poured into the reservoir from a separate container. Generally, this type of dispenser is rather complex for the function it serves and is made up of a relatively large number of parts, for example twenty or more. In view of the relative complexity of this type of dispenser, it is generally too costly for home use. Also, since the reservoir must be filled from a separate container it is somewhat inconvenient for use within the home.

SUMMARY OF THE INVENTION

The present invention is directed to a dispensing enclosure for holding a liquid container in an inverted position wherein a dispensing opening of the container is disposed downwardly. The enclosure includes a housing having a plurality of walls and a means for holding a liquid container in a position within the housing wherein a dispensing opening of the container is disposed downwardly. A dispensing control means is provided for selectively opening and closing the dispensing opening of the liquid container.

In a preferred embodiment, the housing is comprised of a stationary portion which has a rear wall adapted to be attached to a support surface and which has a plurality of walls extending forwardly therefrom. The housing also includes a movable portion connected to the stationary portion and movable relative thereto. The movable portion includes a front wall and a plurality of walls extending rearwardly therefrom. The dispensing control means includes a sealing member comprised of an arm extending from the stationary portion of the housing with a sealing plug extending from the arm. In a sealing position, the plug is biased into the dispensing opening of the liquid container. The biasing is preferably accomplished by forming the arm from high memory plastic with a first generally downwardly extending section and a second section extending from the first section at a slightly upward angle such that the plug is disposed at a point above the location of the dispensing opening with no liquid container is held within the housing. Thus, when a liquid container is placed within the housing, the tip of the container presses down against the sealing plug and the sealing plug is biased upwardly into the dispensing opening. The dispensing control means also includes an actuating surface connected to the movable portion of the housing. The actuating surface contacts the arm to move the sealing plug out of engagement with the dispensing opening by pressing the front wall inwardly toward the rear wall. A projection extends from an inner surface of the movable portion to squeeze the liquid container and thereby pressurize the liquid therein during the dispensing operation.

The stationary and movable portions of the housing are each preferably made of a single integral piece of plastic. The dispensing enclosure is thus made of essentially only three pieces, i.e., the two portions of the housing and the spring arm. Such a three piece construction keeps the cost of manufacture relatively low so that the dispensing enclosure can be economically used within a household.

The liquid which is to be dispensed is contained within a liquid container which is held within the housing and is readily replaceable. When the container is emptied of liquid, the container can be conveniently replaced with another container of the liquid, thereby making the dispensing enclosure, combined with the liquid container, a convenient household liquid dispenser.

Various advantages and features of novelty which characterize the invention are pointed out with particularity in the claims, annexed hereto and forming a part hereof. However, for a better understanding of the invention and the advantages obtained by its use, reference should be had to the Drawings which form a further part hereof and to the accompanying descriptive matter in which there is illustrated and described an embodiment of the invention.

DETAILED DESCRIPTION OF THE INVENTION

Figure 1:
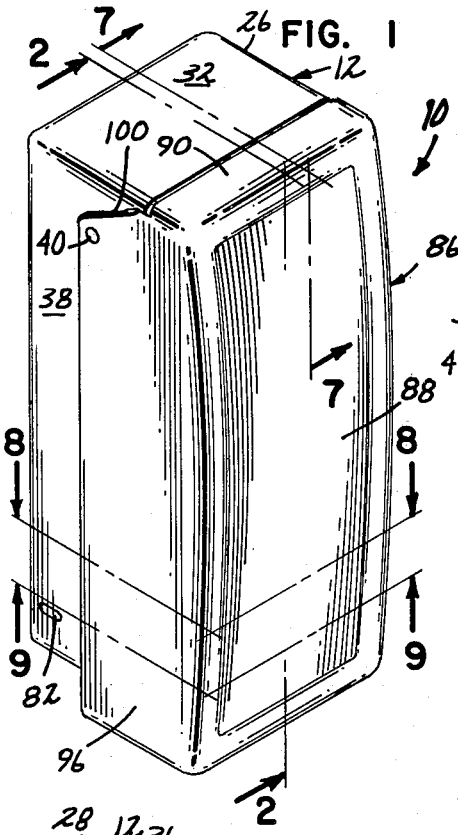
FIG. 1 is a perspective view of the dispensing enclosure of the present invention.

Referring to the drawings in detail, wherein like numerals indicate like elements, there is shown in FIG. 1 a dispenser indicated generally as 10. The dispenser 10 is comprised of a dispensing enclosure 12 and a liquid container 14 removably held within the enclosure 12.

Figure 6:
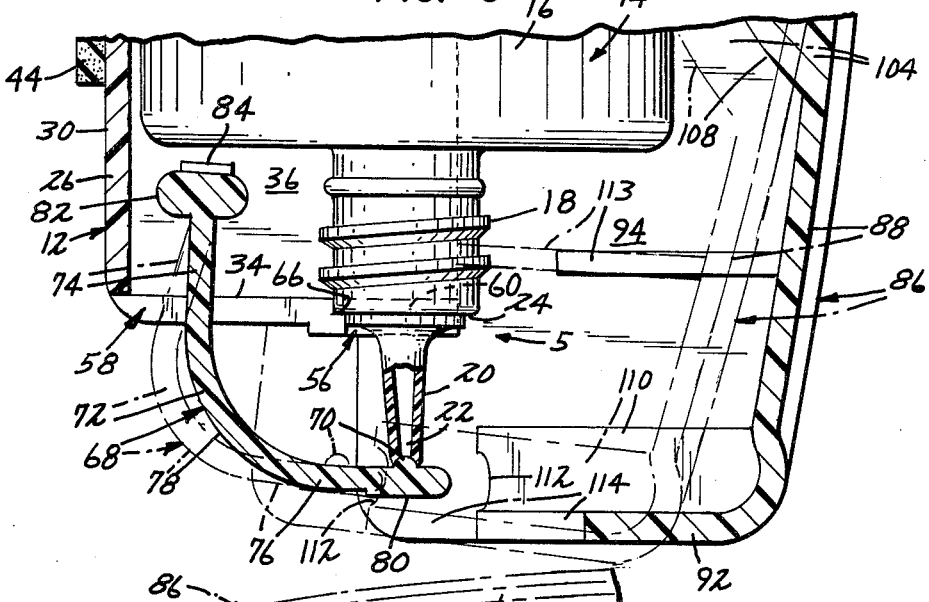
FIG. 6 is a sectional view similar to FIG. 2 of a lower portion of the dispensing enclosure, on an enlarged scale, showing the sealing member in a sealing position in full line, and in a dispensing position in phantom line.

The liquid container 14 is a flexible walled container, preferably made of a flexible plastic material capable of being deformed from its normal configuration with sufficient memory to return to its original configuration after pressure has been released from the flexible wall. The container 14 has a generally cylindrical containing section 16 with a threaded top 18 extending from it. A dispensing tip 20 extends from the threaded top and has a dispensing opening 22. A removable cap (not shown) threads onto the threaded top 18 to seal the container 14 before it is placed in the dispensing enclosure 12. As is best seen in FIG. 6, a top surface of the threaded top 18 forms an annular ledge 24 at the juncture between the top 18 and the tip 20. After a container 14 has been completely emptied of liquid, the dispenser 10 is recharged for use simply by inserting another full container 14.

The dispensing enclosure 12 is formed as a two part housing. A first or stationary portion 26 of the housing or enclosure is adapted to be secured to a support surface such as a wall 28. First portion 26 includes a rear wall or face 30, a top wall 32, a bottom wall 34 and a pair of opposite side walls 36, 38. The walls 32, 34, 36 and 38 extend forwardly from the rear wall 30. A pivot pin 40 extends from the outer surface of the wall 38 and a pivot pin 42 extends from the outer surface of the wall 36. A strip of self-adhesive material 44 is attached to the exterior surface of rear wall 30. An outwardly facing surfacing of the material 44 is covered with a removable piece of protective material during storage. The protective material is removed from the self-adhesive material 44 when the dispensing enclosure 12 is to be attached to the wall 28. After removing the protective material, the exterior surface of the self-adhesive material is merely pressed to a support surface, such as wall 28 to attach the dispensing enclosure 12 to the wall.

Figure 9:
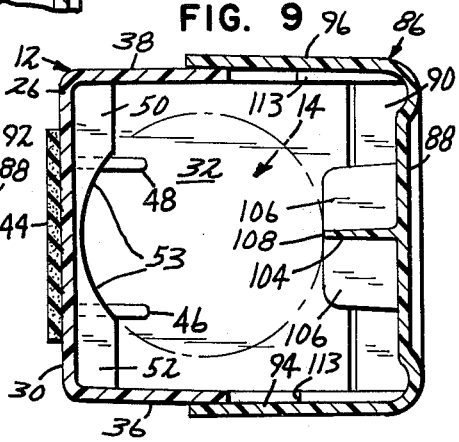
FIG. 9 is a sectional view taken generally along lines 9—9 of FIG. 1.

The interior of the first portion 26 includes a means for holding the liquid container or bottle 14 within the enclosure 12. A pair of top ridges 46, 48 are spaced laterally from one another and extend forward from the interior of rear wall 30 and downward from the top wall 32 as is best seen in FIG. 9. The top ridges 46, 48 are adapted to contact a bottom of the container 14 to properly align the container 14 in the up and down or lengthwise direction. A transverse ridge 50 extends from the rear wall 30 and the side wall 38, and a second transverse ridge 52 extends from the rear wall 30 and the side wall 36. Each transverse ridge 50, 52 has a curved surface 53 aligned about a center line extending along the lengthwise dimension of the enclosure 12. The curved surfaces 53 are shaped to receive and align the outer curved surface of the container 14. The transverse ridges 50, 52 are disposed below the ridges 46, 48 so as to contact the container 14 at a point approximately one-third of the length of the container away from its bottom.

A retaining groove 54 is formed in the bottom wall 34. The retaining groove 54 includes a curved tip holding section 56 at the forward end of the wall 34 and a generally linear slot 58 extending rearwardly from the section 56 to the rear wall 30. The curved section 56 includes a pair of facing curved surfaces 60 which curve symmetrically about a longitudinal central line of the enclosure 12. The curved surfaces 60 each have a front edge 62 which extends around past a transverse center plane of the curved section 56 indicated by line 64 in FIG. 9. A ridge or ledge 66 is formed in the curved surfaces 60. As seen in FIG. 6, the tip 20 is received within the curved surfaces 60 and below the ridge 66. The annular ledge 24 of the threaded top 18 rests within the ledge 66. Since the front edges 62 of the curved surface 60 extend forward of the transverse plane 64, the front edges 62 extend around a portion of the front of the tip 20 and serve as a retaining clip to hold the tip 20 within the retaining groove 54. The outermost ends of the front edges 62 are curved to serve as camming surfaces to allow the tip 20 to spread the surfaces 60 away from each other to thereby snap the tip 20 into place within the retaining groove 54.

Figure 8:
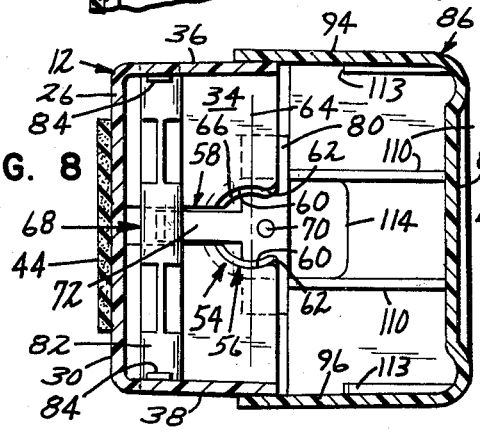
FIG. 8 is a sectional view taken generally along lines 8—8 of FIG. 1.

As seen in the drawings, the container 14 is held within the enclosure 12 without a cap so that the dispensing opening 22 is open. A sealing means, designated generally as 68 is therefore provided to selectively seal or close the opening 22. The sealing means 68 is comprised of a sealing plug 70 extending from a portion of an arm 72. The arm 72 has a generally vertically extending section 74 and a generally horizontally extending section 76. A lower end of the section 74 is connected to a back end of the section 76 by a curved section 78. A T-arm 80 extends transversely to either side of a front end of the section 76. The plug 70 is generally ball-shaped and extends upwardly from an upper surface of the T-arm 80. The arm 72 is connected to the first portion 26 of the enclosure 12 by means of a connector bar 82 which extends transversely from either side of an upper end of the section 74. The vertical section 74 extends downward from the connecting bar 82 through the linear slot 58 in the bottom wall 34. Outer ends of the connector bar 82 are each received within a hole in one of the side walls 36, 38 as shown in FIG. 1. To keep the connector bar aligned between the side walls 36, 38, a projection 84 extends from an upper surface of the bar 82 adjacent each free end. See FIG. 8.

Figure 10:
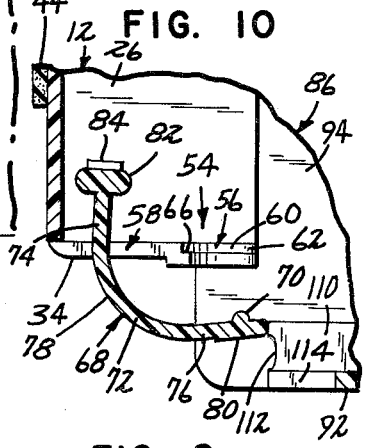
FIG. 10 is a partial sectional view of the lower portion of the housing illustrating the position of the sealing member when no container is held within the housing.

Without a bottle or container 14 supported in the enclosure 12, the arm 68 assumes the position shown in in FIG. 10. As seen therein, the section 76 of the arm 72 extends from the section 78 at a slightly upward angle and the plug 70 is disposed at a location above the point where the bottom of dispensing opening 22 will be located when the container 14 is supported within the enclosure 12. After a container 14 has been placed in the enclosure 12, the arm 72 is moved to the position shown in full line in FIG. 6. In this position, the arm 72 provides an upward biasing force to press plug 70 within opening 22 in a sealing manner. Arm 72 serves as a spring bias. As will be explained more fully hereinafter, in a dispensing position, the arm 72 is moved to the phantom line position shown in FIG. 6. So that the arm 72 can repeatedly perform the sealing function, arm 72 is preferably made of a high memory plastic material, commonly known as spring plastic with a perfect memory, such as acetal.

A second portion 86 of the housing or enclosure 12 is connected to the first portion 26 and is movable relative thereto. The second portion 86 has a front wall or face 88, a top wall 90, bottom wall 92, and opposing side walls 94, 96. The walls 90, 92, 94 and 96 extend rearwardly from the front wall 88. In order to movably mount the second portion 86 to the first portion 26, the pins 40, 42 each pass through a hole in one of the side walls 94, 96.

Figure 7:
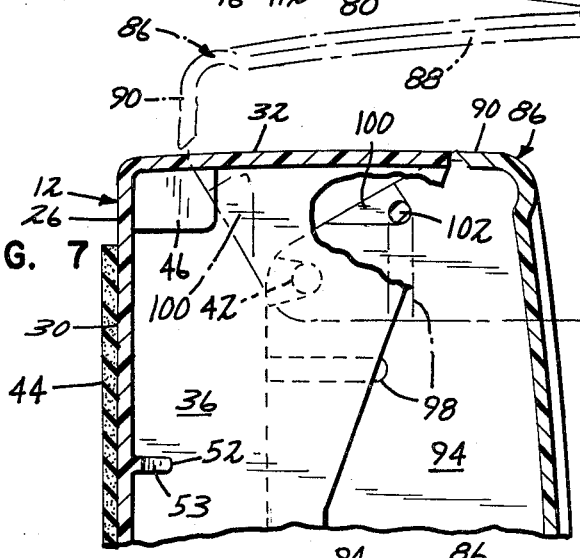
FIG. 7 is a sectional view taken generally along lines 7—7 of FIG. 1 illustrating the movable portion of the housing in a closed operative position in full line and in an upward locked open position in phantom line.

Each wall 94, 96 has a pair of grooves 98, 100 formed in its inner surface adjacent a top end of the respective side wall. A secondary pin 102 extends from an outer surface of each side wall 36, 38 adjacent the top end of the first portion 26. When the second portion 86 is in its downward operative position, the pin 102 is received within the groove 100. The second portion 86 is pivotable about pins 40, 42 to an upward open position shown in phantom line in FIG. 7. In such an upward open position, access is gained to the interior of the first portion 26 so that the liquid container 14 can be readily inserted therein. So that the movable portion 86 does not have to be held in the upward open position, the grooves 98 serve as locking grooves. That is, the pins 102 are received within the grooves 98 in the upward open position of the second portion to hold it in the position shown in phantom line in FIG. 7. The pin 102 is movable between the grooves 98 and 100 because of the spring type flexibility of the side walls 94, 96 of the movable portion 86.

A projection 104 extends from the inner surface of the front wall 88 into the interior of the enclosure 12. A pair of lateral extensions 106 also extend inwardly from the interior surface of the front wall 88 and laterally outward from the opposite sides of the projection 104. The projection 104 has a generally curved contact surface 108 which extends along the lengthwise dimension of the enclosure 12 approximately along the center line thereof. As will be discussed more fully hereinafter, the contact surface 108 serves as a means for pressurizing the liquid in the container 14 during dispensing.

Figure 2:
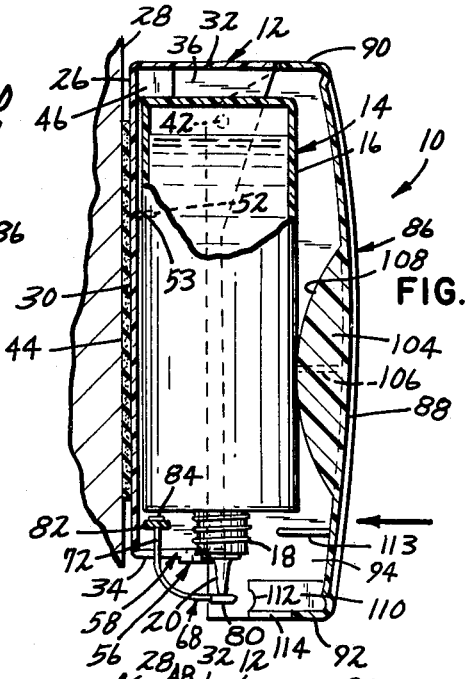
FIG. 2 is a sectional view taken generally along lines 2—2 illustrating the dispensing enclosure attached to a wall with a liquid container held within the enclosure.
Figure 4:
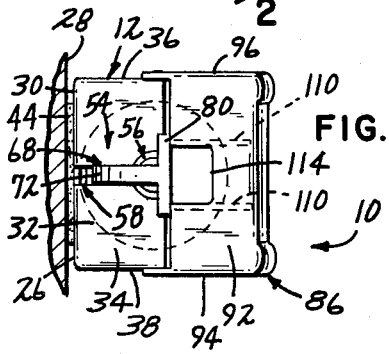
FIG. 4 is a bottom plan view of the dispensing enclosure with the sealing member in a sealing position.
Figure 3:
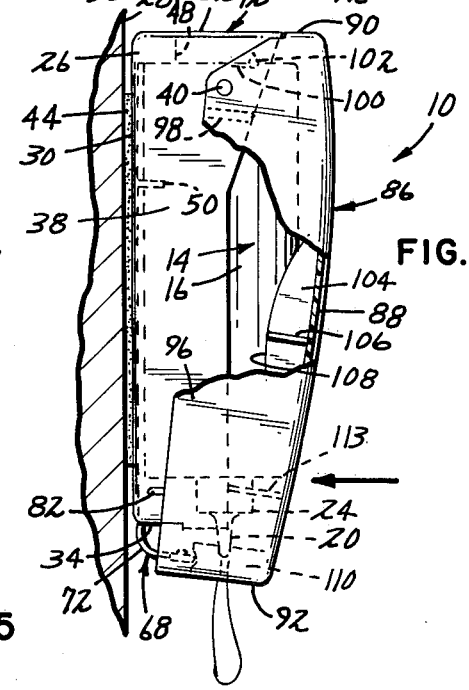
FIG. 3 is a side elevational view, partially broken away, illustrating the movable portion of the housing moved toward the stationary portion of the housing to thereby move the sealing member to a dispensing position.

A pair of spaced actuating bars 110 extend upwardly from the bottom wall 92 and rearwardly from the front wall 88. A curved camming surface 112 is formed in the vertical rearward end of each actuating bar 110. The camming surfaces 112 move the arm 72 from the position shown in FIG. 2 to the position shown in FIG. 3 when the movable portion 86 is pivoted toward the stationary portion 26 as shown in FIG. 3.

A pair of stop members 113 are formed on each on the interior surface of one of the walls 94, 96 to limit movement of second portion 86 toward first portion 26.

The liquid dispenser 10 is used in the following manner. A container 14 holding a desired liquid is selected and the top is removed. The movable portion 86 of the enclosure 12 is pivoted to its upward open position shown in phantom line in FIG. 7. While moving from its downward position to its upward position, the pins 102 leave the grooves 100 and enter the groove 98 to thereby hold the movable portion 86 in the open position. The container or bottle 14 is thereafter slid into position within the stationary portion 26 of the enclosure 12. The tip 20 is forced between the curved outer ends of the opposing curved surfaces 60 so that the curved surfaces move slightly away from one another. The tip 20 thus snaps into place within the retaining groove 54 with the front edges 62 thereof positioned around the front portion of the tip 20 to thereby hold the container 14 in place. As shown in FIG. 6, the annular ledge 24 rests upon the ridge or ledge 66 formed in the retaining groove 54. Also, as seen in FIG. 6, the tip 20 moves the arm 72 downward against its own spring bias so that the plug 70 fits within the dispensing opening 22 and is biased upwardly therein.

Figure 5:
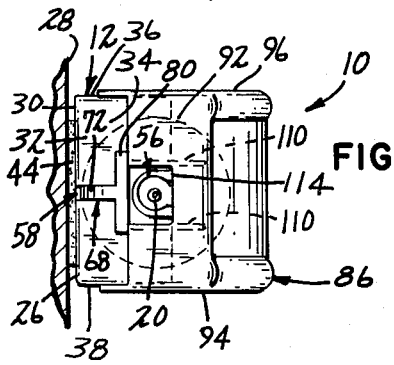
FIG. 5 is a bottom plan view of the dispensing enclosure with the sealing member in a dispensing position.

When the liquid is to be dispensed, the movable portion 86 is pivoted toward the stationary portion 26 about the pins 40, 42 by pressing against the front wall 88. As the movable portion 86 pivots rearwardly, the curved contact surface 108 of the projection 104 contacts the flexible wall of the liquid container 14 and bends the wall inwardly as shown in FIG. 3. This places the liquid within the container 14 under pressure. As the movable portion 86 pivots rearwardly, the actuating bars 110 come into contact with the T-arm 80 of the arm 72. Each camming surface 112 contacts the T-arm 80 such that it first moves downwardly to move the plug 70 out of the dispensing opening 22 and, thereafter moves the T-arm 80 and plug 70 rearwardly to the position shown in phantom line in FIG. 6 and in full line in FIG. 3. In such a position, a cutout area 114 in the bottom wall 92 is aligned with the dispensing opening 22 when stop members 113 engage side walls 36, 38 of first portion 26. In this position the liquid can be dispensed downwardly through opening 114 as shown in FIGS. 3, 5 and 6. By depressing the wall 88 once, a generally measured amount of liquid is dispensed. If the wall 88 is kept depressed, air may enter through the dispensing opening 22 and a small additional amount of liquid may be dispensed. However, it is preferable to depress the wall 88 a second time to obtain a second measured amount of liquid. The container 14 has a flexible wall which acts as a spring to return the movable portion 86 of the enclosure 12 to its non-dispensing position shown in FIG. 2. The motion of the flexible wall of the container 14 from its collapsed to its natural shape also helps to draw in air and liquid which has not yet been dispensed. The plug 70 is also automatically moved back to its sealing position by the spring arm 78. As mentioned above, the arm 78 is preferably made of a high memory plastic material capable of returning to its original position.

Numerous characteristics and advantages of the invention have been set forth in the foregoing description, together with details of the structure and function of the invention, and the novel features thereof are pointed out in the appended claims. The disclosure, however, is illustrative only, and changes may be made in detail, especially in matters of shape, size, and arrangement of parts, within the principle of the invention, to the full extent extended by the broad general meaning of the terms in which the appended claims are expressed.

What is claimed is:

1. A dispensing enclosure for holding a flexible walled liquid container in a position wherein an outlet of the container is disposed downwardly, said enclosure comprising:

a housing having a back portion adapted for attachment to a support surface and a front portion;

means for coupling the front portion to the back portion of said housing for movement relative thereto;

means for releasably securing the liquid container in an inverted position on the back position of said housing such that the outlet of the container is disposed downwardly;

a sealing plug adapted for receipt in the outlet of the container;

a spring arm mounted on the back portion of said housing for supporting said sealing plug for movement between a sealing position in the outlet of the container and a dispensing position away from the container outlet, said spring arm normally biasing said plug toward the sealing position;

means mounted on the front portion of said housing for engaging and applying pressure to the container as the front housing portion is moved toward the back portion of said housing; and means mounted on the front portion of said housing for engaging said spring arm and for moving said sealing plug to the dispensing position as the front portion is moved toward the back housing portion to thereby dispense liquid from the container.

2. A dispensing enclosure in accordance with claim 1 wherein the back portion of the housing includes a rear wall and a plurality of side walls extending forwardly from said rear wall, and wherein the front portion of said housing includes a front wall and a plurality of side walls extending rearwardly therefrom.

3. A dispensing enclosure in accordance with claim 2 wherein portions of the side walls of the front and back portions overlap in the operative position of said portions of said housing, and said coupling means includes means pivotably connecting an upper end of said front portion to an upper end of said back portion of said housing.

4. A dispensing enclosure for holding a liquid container in a position wherein a dispensing opening of the container is disposed downwardly, said enclosure comprising:

a housing having a plurality of walls;

means for holding the liquid container in a position within said housing wherein the dispensing opening of the container is disposed downwardly;

dispensing control means for selectively opening and closing the dispensing opening of the liquid container;

said dispensing control means including a movable sealing member movable between a sealing position wherein the sealing member is disposed in a position to prevent liquid from flowing out of the dispensing opening of the liquid container and a dispensing position wherein the sealing member is disposed in a position to permit liquid to flow out of the dispensing opening of the liquid container, and means for moving said sealing member from said sealing position to said dispensing position;

said sealing member moving means including a portion of said housing movable with respect to another stationary portion of said housing;

said stationary portion of the housing including a rear wall adapted to be attached to a support surface and a plurality of stationary walls extending forwardly from said rear wall, and wherein said movable portion of said housing includes a front wall and a plurality of movable walls extending rearwardly therefrom, and including coupling means for movably connecting said movable portion to said stationary portion; and said sealing member including a plug for reception in the dispensing opening of the liquid container, and an arm attached to the stationary portion of the housing, said plug extending from a section of said arm, and wherein said sealing member moving means includes an actuating surface on said movable portion of the housing for contacting said arm and moving said plug out of the dispensing opening when said movable portion is moved toward said stationary portion.

5. A dispensing enclosure in accordance with claim 4 wherein said arm includes a generally vertically extending portion and a generally horizontally extending portion, said generally horizontal portion extending from said generally vertical portion at a slight upward angle, said plug being disposed adjacent a free end of said generally horizontal portion in a disposition such that said plug is disposed at a location above the location at which the dispensing opening of the liquid container is disposed when said container is held in said housing whereby said plug is biased into sealing engagement with the dispensing opening when the liquid container is held within the housing.

6. A dispensing enclosure for holding a flexible walled liquid container in an inverted position wherein a dispensing opening of the container is disposed downwardly and liquid is to be dispensed therefrom, said enclosure comprising:

a housing having a first portion and a second portion movable relative to the first portion;

said first housing portion having a rear wall adapted to be attached to a support surface and a plurality of walls extending forwardly therefrom;

means for connecting said second portion to said first portion for motion relative thereto;

said second housing portion having a front wall spaced from said rear wall and a plurality of walls extending rearwardly therefrom;

holding means for holding a flexible walled liquid container in an inverted position wherein the dispensing opening of the container is disposed downwardly;

means mounted on said first housing portion for selectively sealing the dispensing opening of the liquid container, said sealing means being biased to a sealing position wherein flow of liquid through the dispensing opening is blocked and being movable to a dispensing position wherein liquid is free to flow out of the dispensing opening; and actuating means mounted on said second housing portion for applying pressure to the flexible container and for moving said sealing means from said sealing position to said dispensing position.

7. A dispensing enclosure in accordance with claim 6 wherein said actuating means includes a projection extending from an interior surface of one of the walls of said second portion for applying pressure to the liquid container when the front wall is moved toward said rear wall, and an actuating surface extending from said second portion for contacting and moving said sealing means from its sealing position to its dispensing position when said front wall is moved toward said rear wall.

8. A dispensing enclosure for holding a flexible walled liquid container in an inverted position wherein a dispensing opening of the container is disposed downwardly and liquid is to be dispensed therefrom, said enclosure comprising:

a housing having a first portion and a second portion movable relative to the first portion;

said first portion having a rear wall adapted to be attached to a support surface and a plurality of walls extending forwardly therefrom;

means for connecting said second portion to said first portion for motion relative thereto;

said second portion having a front wall spaced from said rear wall and a plurality of walls extending rearwardly therefrom;

holding means for holding a flexible walled liquid container in an inverted position wherein a dispensing opening of the container is disposed downwardly;

means for selectively sealing the dispensing opening of the liquid container, said sealing means being biased to a sealing position wherein flow of liquid through the dispensing opening is blocked and being movable to a dispensing position wherein liquid is free to flow out of the dispensing opening; and actuating means connected to said movable portion for applying pressure to the flexible container and for moving said sealing means from said sealing position to said dispensing position;

said actuating means including a projection extending from an interior surface of one of the walls of said second portion for applying pressure to the liquid container when the front wall is moved toward said rear wall, and an actuating surface extending from said second portion for contacting and moving said sealing means from its sealing position to its dispensing position when said front wall is moved toward said rear wall;

said sealing means including a spring arm connected to the first portion of said housing, said arm having a first section extending generally vertically downwardly and a second section extending from said first section at an angle above a horizontal plane, said second section of the arm having a free end with a sealing plug extending upwardly therefrom, said sealing plug being disposed at a vertical location above the vertical location where the dispensing opening of a liquid container would be disposed if it were held in said housing whereby said plug is spring biased in an upward direction when the liquid container is held within said housing.

9. A dispensing enclosure in accordance with claim 8 wherein said actuating surface extends from a bottom wall of said plurality of walls extending from said front wall, said bottom wall having a cut-out area for alignment under the dispensing opening when said actuating means has moved said sealing plug out of sealing engagement with the dispensing opening.

10. A dispensing apparatus in accordance with claim 9 wherein said actuating surface includes a camming surface for first moving said sealing plug downwardly and thereafter rearwardly.

11. A dispensing enclosure for holding a flexible walled liquid container in an inverted position wherein a dispensing opening of the container is disposed downwardly and liquid is to be dispensed therefrom, said enclosure comprising:

a housing formed of a first discrete integral portion and a second discrete integral portion pivotable relative to the first portion;

said first portion having a rear wall adapted to be attached to a support surface and a plurality of walls extending forwardly therefrom;

said second portion having a front wall spaced from said rear wall and a plurality of walls extending rearwardly therefrom;

pivot means formed integral with one of said first and second portions adjacent an upper end thereof for connecting said second portion to said first portion for pivotal motion between a downward operative position and an upward open position;

means for releasably locking said movable portion in said upward open position;

holding means for holding a flexible walled liquid container in an inverted position within said housing wherein a dispensing opening of the container is disposed downwardly;

a spring arm extending from said first portion, said arm having a section extending upwardly at an angle above the horizontal and having a sealing plug extending from its upper surface adjacent its outer free end, said arm being disposed such that said plug is located at a position above the position at which the dispensing opening of the liquid container would be disposed when held within said housing; and actuating means connected to said pivotable portion for applying pressure to the flexible container and for moving said plug from a sealing position wherein the flow of liquid through the dispensing opening is blocked to a dispensing position wherein the liquid is free to flow out of the dispensing opening, said actuating means including a contact surface on the interior of said pivotable portion for contacting and pressing the flexible wall of the container and an actuating surface for contacting a portion of said arm to move said plug from said sealing position to said dispensing position.

12. A dispensing enclosure in accordance with claim 11 wherein said arm is formed of a high memory plastic material whereby said arm functions as a spring to bias the plug to the sealing position.

13. A dispensing enclosure in accordance with claim 12 wherein said arm includes a first section extending vertically downwardly and a curved section connecting said vertical section to said upwardly inclined section, and a T-arm extending transversely on either side of the free end of said upwardly disposed section.

14. A dispensing enclosure in accordance with claim 13 wherein said arm includes a connecting bar attached to said vertical section and extending in a widthwise direction, said connecting bar having opposite ends each connected to one of the side walls of said first portion of the housing.

15. A dispensing enclosure in accordance with claim 11, 12 or 13 wherein said contacting surface is an outer surface of a curved projection extending from an interior surface of the front wall.

16. A dispensing enclosure in accordance with claim 15 wherein the actuating surface includes a pair of laterally spaced surfaces each adapted to contact said T-arm on an opposite side of the plug, and wherein a bottom wall of the walls extending from said front wall has a cutout area for alignment with the dispensing opening of the liquid container when said plug is moved to its dispensing position.

17. A dispensing enclosure in accordance with claim 13 wherein said actuating surface includes a pair of actuating projections each extending from a bottom wall of the plurality of walls extending from said front wall, each actuating projection having a surface facing said rear wall adapted to contact the T-arm on an opposite side of said plug, and wherein said bottom wall has a cutout area between said actuating projections for alignment with the dispensing opening of the liquid container in a dispensing position of said sealing plug.

18. A dispensing enclosure in accordance with claim 17 wherein the rearwardly facing surface of each actuating projection is a curved camming surface for first moving said T-arm and sealing plug downwardly and thereafter rearwardly as said second portion pivots toward said first portion.

19. A dispensing enclosure in accordance with claim 11 wherein said pivot means includes a pivot pin formed integral with each side wall of the plurality of walls extending from said rear wall and said locking means includes a secondary pin extending from each of said last-mentioned side walls and a groove formed in each side wall of said plurality of walls extending from said front wall for reception of said secondary pin in the open position of said second pivotable portion of the housing.

20. A dispensing enclosure in accordance with claim 11 wherein said holding means includes a projection extending from the interior of said first portion of the housing for aligning the liquid container along the longitudinal center line of the housing and a retaining groove for receiving a tip of the liquid container.

21. A dispensing enclosure in accordance with claim 20 wherein said retaining groove is formed in a bottom wall of said first portion of the housing and includes a pair of opposed curved surfaces having a gap disposed toward the front of the enclosure and having front edges adapted to extend around a forward portion of the tip of the liquid container, and wherein another groove extends from said retaining groove rearwardly through the bottom wall of the first portion toward the rear wall, the vertical section of said arm extending through said other groove.

22. A liquid dispenser comprising:

a flexible walled liquid container for holding a liquid to be dispensed, said container having a dispensing opening;

a housing for supporting said liquid container in an inverted position wherein the dispensing opening of said liquid container is disposed downwardly, said housing including a first integral portion and a second integral portion connected to said first portion for pivotable motion relative thereto;

said first portion including a rear wall adapted to be connected to a support surface, and a top wall, a pair of side walls and a bottom wall each extending forwardly from said rear wall;

said second portion including a front wall, and a top wall, a pair of opposite side walls and a bottom wall each extending rearwardly from said front wall;

pivot means for pivotably connecting an upper end of said second portion to said first portion for pivotable motion of said second portion between an upward open position and a downward operative position;

means for releasably locking said second portion in said upward open position;

means for holding said liquid container in said inverted position;

a spring arm extending from said first portion, said spring arm having a section extending upwardly at an angle above the horizontal with a sealing plug extending from said section whereby said plug is spring biased into said dispensing opening of said liquid container and is movable from a sealing position within the dispensing opening to a dispensing position out of said dispensing opening; and actuating means for applying pressure to said liquid container and for moving said plug to said dispensing opening to dispense liquid from said container.

* * * * *